US008985885B2

(12) United States Patent
Kang

(10) Patent No.: US 8,985,885 B2
(45) Date of Patent: Mar. 24, 2015

(54) CONTAINER FOR DISPENSING PRESET AMOUNT OF LIQUID CONTENT

(75) Inventor: Sung-Hwan Kang, Gwangmyeong-si (KR)

(73) Assignee: Hana Co., Ltd., Hwaseong (KR)

( * ) Notice: Subject to any disclaimer, the term of this patent is extended or adjusted under 35 U.S.C. 154(b) by 814 days.

(21) Appl. No.: 13/139,728

(22) PCT Filed: Dec. 2, 2009

(86) PCT No.: PCT/KR2009/007128
§ 371 (c)(1),
(2), (4) Date: Jun. 15, 2011

(87) PCT Pub. No.: WO2010/071309
PCT Pub. Date: Jun. 24, 2010

(65) Prior Publication Data

US 2011/0250007 A1 Oct. 13, 2011

(30) Foreign Application Priority Data

Dec. 16, 2008 (KR) ..... 20-2008-0016686

(51) Int. Cl.
*A45D 34/04* (2006.01)
*A46B 11/02* (2006.01)
*A46B 11/00* (2006.01)

(52) U.S. Cl.
CPC ..... *A45D 34/042* (2013.01); *A46B 11/0055* (2013.01); *A45D 2200/055* (2013.01); *A45D 2200/056* (2013.01)
USPC ..... 401/188 R; 401/179; 401/187; 222/383.1

(58) Field of Classification Search
CPC ..... A46B 11/0055
USPC ..... 401/188 R; 222/383.1, 385
See application file for complete search history.

(56) References Cited

U.S. PATENT DOCUMENTS 4,534,669 A * 8/1985 Heck et al. ..... 401/134
4,810,124 A * 3/1989 Krueckel et al. ..... 401/149
(Continued)

FOREIGN PATENT DOCUMENTS

JP 11-206453 A 8/1999

OTHER PUBLICATIONS

International search report of PCT/KR2009/007128 dated Jul. 14, 2010.

*Primary Examiner* — Kevin P Shaver
*Assistant Examiner* — Joshua Wiljanen
(74) *Attorney, Agent, or Firm* — Maxon IP, LLC; Justin H. Kim

(57) ABSTRACT

Disclosed is a pencil-type case for allowing pressing a pressure button to discharge liquid content out to a content brush. The container for dispensing a preset quantity of liquid content accommodated in a main body by pressing a pressure button. The container includes: main body including content case to accommodate content in outer body and having pushing member; pumping member including: folding link driven by pressure button; check valve preventing content from flowing backward when content is introduced into cylinder tube via content-introducing hole formed in cylinder tube, and piston pumping content out to content brush of content brush body; and content brush body including: content-introducing tube in which check valve is installed; cam surface adjusting stroke of folding link; and content brush provided at leading end to discharge content of content-introducing tube.

5 Claims, 8 Drawing Sheets

(56) References Cited

U.S. PATENT DOCUMENTS

| | | | | |
|---|---|---|---|---|
| 4,813,870 | A * | 3/1989 | Pitzen et al. | 433/90 |
| 4,991,749 | A * | 2/1991 | Kay et al. | 222/384 |
| 5,103,560 | A * | 4/1992 | Podolsky | 30/41 |
| 5,110,231 | A * | 5/1992 | Monteith et al. | 401/190 |
| 6,056,470 | A | 5/2000 | Nehashi et al. | |
| 6,200,055 | B1 * | 3/2001 | Fusaro, Jr. | 401/178 |
| 6,200,255 | B1 * | 3/2001 | Yu | 600/1 |
| 6,923,587 | B2 | 8/2005 | Lee | |
| 6,948,875 | B1 * | 9/2005 | Jang | 401/146 |
| 8,308,386 | B2 * | 11/2012 | Ki | 401/188 R |
| 2003/0185620 | A1 * | 10/2003 | Park | 401/270 |
| 2008/0296320 | A1 * | 12/2008 | Kang | 222/394 |
| 2009/0311036 | A1 * | 12/2009 | Pires et al. | 401/263 |
| 2011/0008096 | A1 * | 1/2011 | Coleman et al. | 401/205 |
| 2011/0070016 | A1 * | 3/2011 | Richardson | 401/282 |
| 2011/0158737 | A1 * | 6/2011 | Ki | 401/138 |

* cited by examiner

CONTAINER FOR DISPENSING PRESET AMOUNT OF LIQUID CONTENT

FIELD OF THE INVENTION

The present invention relates to a pencil-type case with a pressure button, which discharges liquid content out to a content brush. More specifically, the present invention relates to a container for dispensing a preset amount of liquid content with the improvement of a pumping member to pump out the content, which may be stably operated anywhere and anytime to discharge the liquid content and enhances the reliability of the container can be enhanced.

BACKGROUND OF THE INVENTION

Volatile liquid content (hereinafter, referred to as "content") that is contained and kept in a container loses its original nature if its moisture or volatile solvent is volatilized into air.

There are some examples of the content containing moisture or volatile substances such as eyeliner, lip-gloss, lip-color, eye serum, anti wrinkle cream, contents and the like.

Preferably, the content is accommodated in a container that minimizes contact with air. Various containers minimizing contact of the content with air are suggested.

For example, Korean Utility Model Nos. 0230104, 0396301 and 0396313 patented to the same applicant disclose a container dispensing a preset amount of content by pressing a pressure button.

The inventions are configured such that a screw rod rotates when a user presses down a pressure button provided to a body and that a piston screw-coupled to the screw rod transports the content so that a content brush discharges the content to use. The container may dispense a preset quantity of content and prevent the content from being volatilized.

However, it is difficult to reduce manufacturing costs because of the complicated mechanisms discharging the content and because more workers are needed for the assembly of the container. Also more assembly time is required due to complicated assembling process, so it is difficult to improve productivity.

In order to solve drawbacks of the disclosed containers, Korean Utility Model Nos. 0408260 and 0439672 disclose new containers The new containers are configured to dispense content with repeated operations such that, when a pump tube is compressed by pressing a pressure button installed in a body, content introduced into the pump tube is discharged to a content brush, and that a content-discharging path is closed and a check valve is opened when the external force applied to the pressure button is removed and the pump tube is restores back to its original state so that the content accommodated in the case body is introduced into the pump tube, and are improvements of the containers disclosed in Korean Utility Model Nos. 0230104, 0396301 and 0396313.

Containers disclosed in Korean Utility Model Nos. 0408260 and 0439672 are simplified in structure and have a device discharging the content without a precise process so that the difficulty in the manufacturing process is solved, manufacturing costs can be reduced, and the simplicity of the assembling process leads to the reduction of manpower for the assembly of the container; also productivity can be improved, resulting in enabling mass production.

The disclosed containers may prevent inferior reliability caused by erroneous function of the device discharging content. However, since the content is discharged only by the operation of compression and restoration of the pump tube, the resilience force of the pump tube should be consistently exhibited. However, since the resilience force of the pump tube varies depending on surrounding conditions (for example, a change in temperature), stable dispensing of the content cannot be achieved.

That is, since the resilience force of the pump tube varies whenever to use in low and high temperature areas, the operations of the pump tube become unstable and due to this the preset quantity of content cannot be discharged, resulting in inferiority of reliability.

SUMMARY OF THE INVENTION

The present invention has been made in view of the drawbacks of containers disclosed in the previously registered Korean Utility Model Registration Nos. 0408260 and 0439672, and the present invention provides a container for dispensing a preset quantity of liquid content with the improvement of a pumping member to discharge the content by repeated operations, during which a folding link is unfolded when a pressure button is pressed and a piston connected to an end of the folding link moves backward to compress a cylinder tube such that the content introduced into the cylinder tube is discharged out a content brush Also, the piston moves forward due to a resilience force of a spring when an external force applied to the pressure button is removed and a content passage is blocked, while a check valve is opened such that the content accommodated in a content case is introduced into the cylinder tube, so that a stable pumping operation can be achieved anywhere without environmental effects.

In accordance with an aspect of the present invention, there is provided a container for dispensing a preset quantity of liquid content accommodated in a main body by pressing a pressure button, the container including: the main body including a content case to accommodate the content in an outer body provided with an assembly and having a pushing member moving as the content is reduced; a pumping member including: a folding link driven by the pressure button installed in a button-mounting groove of the outer body; a check valve preventing the content accommodated in the content case from flowing backward when the content is introduced into a cylinder tube via a content-introducing hole formed in the cylinder tube by the movement of the folding link, and a piston pumping the content introduced into the cylinder tube out to a content brush of the content brush body; and the content brush body including: a content-introducing tube in which the check valve preventing the content accommodated in the content case from flowing backward when the content is introduced into the cylinder tube is installed; a cam surface adjusting a stroke of the folding link; and a content brush provided at a leading end to discharge the content of the content-introducing tube.

Here, the pumping member includes: the cylinder tube formed with the content-introducing hole and a locking annular rim locked to a fixing tube that is inserted into the outer body and positioned at the leading end of the content case; a piston formed with a content passage opened and closed by an airproof packing installed in the cylinder tube; a content-transferring tube installed at the leading end of the piston to discharge the content passing through the content passage out to the content brush and having a support rim formed on an outer circumference of a rear end adjacent to the leading end of the piston to support an end of a spring; the folding link hinged adjacent to the support rim of the content-transferring tube and extending toward the leading end of the content-transferring tube, wherein some of the extending portion protrudes toward the button-mounting groove of the outer body and is connected to the pressure button.

Moreover, the folding link includes: a first link bar hinge including a first hinge block hinged to a hinge shaft formed on the rear end of the content-transferring tube 29 and a second hinge block formed on a position opposed to the first hinge block; and a second tuning fork-shaped link bar split by a width corresponding to a diameter of the content-transferring tube and including rolling wheels provided at the ends, and hinge shafts formed on both ends of an extension bar that is formed at the upper central portion to which the hinge block of the first link bar is connected.

The check valves includes opening and closing balls respectively formed in annular rims and the opening and closing ball are provided with diaphragms having content-transferring holes.

As described above, a container of the present invention dispenses a preset quantity of liquid content with the improvement of a pumping member to discharge the content by repeated operations, during which a folding link is unfolded when a pressure button is pressed and a piston connected to an end of the folding link moves backward to compress a cylinder tube such that the content introduced into the cylinder tube is discharged out a content brush, and during which the piston moves forward due to a resilience force of a spring when an external force applied to the pressure button is removed and a content passage is blocked, while a check valve is opened such that the content accommodated in a content case is introduced into the cylinder tube. Stable pumping operations can be achieved anywhere without environmental effects and market competitiveness can be guaranteed.

BRIEF DESCRIPTION OF THE INVENTION

Figure 1:
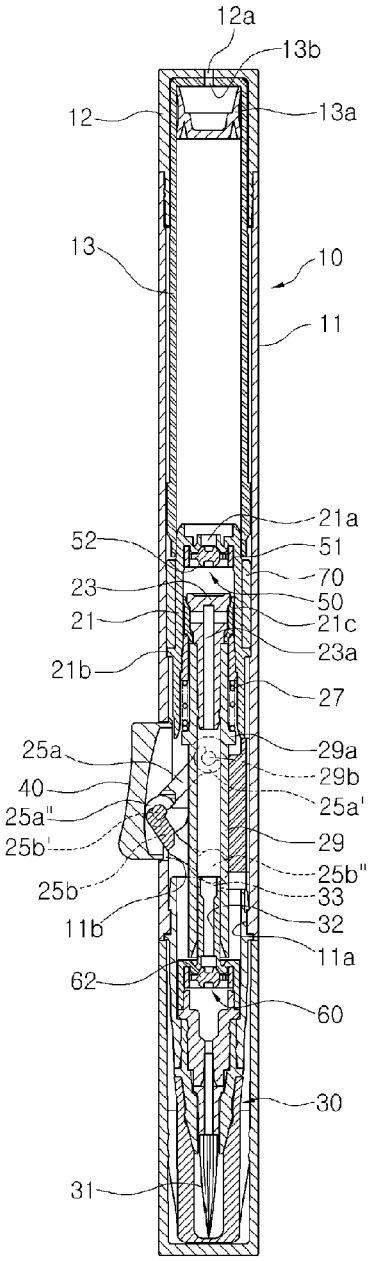
FIG. 1 is a sectional view illustrating a container for dispensing a preset quantity of liquid content according to an embodiment of the present invention.
Figure 2:
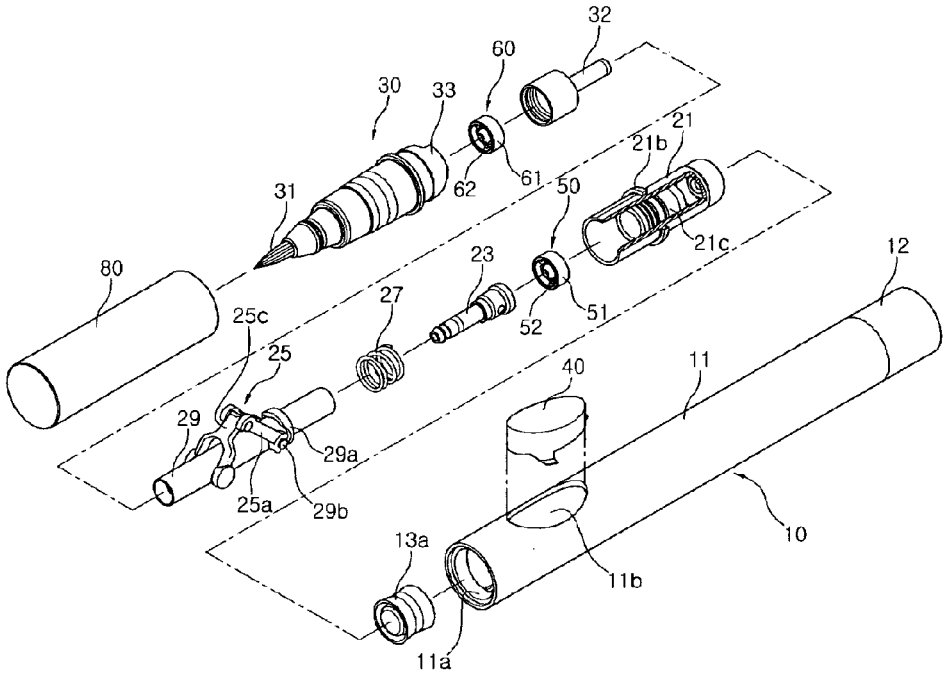
FIG. 2 is an exploded perspective view illustrating a container for dispensing a preset quantity of liquid content according to an embodiment of the present invention.
Figure 3:
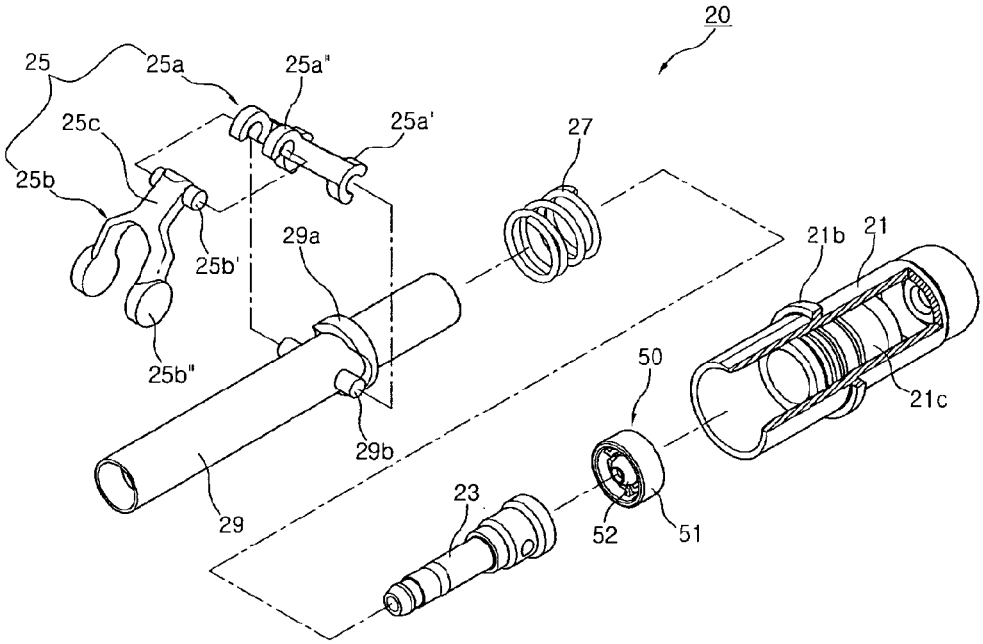
FIG. 3 is an exploded perspective view illustrating main parts of a container for dispensing a preset quantity of liquid content according to an embodiment of the present invention.

<the descriptions of numerical references in the drawings>

| | | | |
|---|---|---|---|
| 10: | main body | 11: | outer body |
| 13: | content case | 20: | pumping member |
| 21: | cylinder tube | 23: | piston |
| 25: | folding link | 25a: | first link bar |
| 25b: | second link bar | 27: | spring |
| 29: | content-transfering tube | 30: | content brush body |
| 31: | content brush | 32: | content introducing tube |
| 40: | pressure button | 50, 60: | check valve |
| 70: | fixing tube | | |

DETAILED DESCRIPTION OF THE INVENTION

Hereinafter, exemplary embodiments of the present invention are described in detail with reference to the accompanying drawings. Particular terms may be defined to describe the invention in the best manner. Accordingly, the meaning of specific terms or words used in the specification and the claims should not be limited to the literal or commonly employed sense, but should be construed in accordance with the spirit of the invention. The description of the various embodiments is to be construed as exemplary only and does not describe every possible instance of the invention. Therefore, it should be understood that various changes may be made and equivalents may be substituted for elements of the invention.

As shown in FIGS. 1 to 6, a container for dispensing a preset quantity of liquid content according to an embodiment of the present invention may be applied to the content, foods, stationery, and medical products.

The container for dispensing a preset quantity of liquid content according to an embodiment of the present invention includes a main body 10 having an outer body 11 with an assembly and a content case 13 positioned inside the outer body 11, a pumping member 20 positioned on a leading end of the outer body 11 to pump the content out in association with an operation of a pressure button 40, and a content brush body 30 positioned on a leading end of the pumping member 20 and mounted in the content case 13.

The main body 10 includes a content case 13 into which content is accommodated and the outer body 11 positioned outside of the content case 13. The content case 13 has an opened upper side, a pushing member 13*a* installed therein to push the content accommodated therein up, and an air introducing hole 13*b* allowing the movement of the pushing member 13*a*.

The outer body 11 mounted outside of the content case 13 has a locking step, formed on an inner side of an end, to which the content brush body 30 is undercut mounted, a button-mounting groove 11*b*, formed at a point adjacent to an end (hereinafter, referred to as 'a leading end'), to which the pressure button 40 is mounted, and an assembly 12 with an air-introducing hole 12*a* undercut mounted on the opposed end (hereinafter, referred to as 'a rear end').

As such, the assembly 12 is mounted on the rear end of the outer body 11 so that the content case 13 installed in the outer body 11 may be replaced as necessary. In more detail, when the content accommodated in the content case 13 are exhausted, a user separates the assembly 12 from the rear end of the outer body 11 to draw the content case 13 out of the outer case 11. Then, a new content case 13 filled with content is inserted in the outer body 11 for the connection of the content case 13 with the cylinder tube 21 so that the newly filled content is fed from the content case 13 to the cylinder tube 21.

As such, since the detachable assembly 12 is mounted on the rear end of the outer body 11 such that the content case 13 the content of which is exhausted may be replaced with the new content case 13 with which content is newly filled may be replaced, the container for dispensing a preset quantity of liquid content according to an embodiment of the present invention is conveniently used.

The pumping member 20 is mounted inside the leading end of the outer body 11. The pumping member 20 includes the cylinder tube 21, a piston 23 reciprocating within the cylinder tube 21, a content transferring tube 29 into which the content introduced from the piston 23, and a folding link 25 having a first link bar 25*a* and a second link bar 25*b*.

The cylinder tube 21 has a rear end having a content-introducing hole 21*a* in which a check valve 50 is installed is connected and connected to the leading end of the content case 13 and a locking annular rim 21*b* locked to a fixing tube 70 that is inserted into the outer case 11.

The piston 23 is installed at the inner side of the cylinder tube 21 to receive an resilient force of a spring 27. An end of the spring 27 is supported by a support rim 29*a* of the content transferring tube 29 extending from the piston 23 so that the resilient force of the spring 27 is applied to the piston 23.

The piston 23 has a content passage 23*a* selectively opened and closed by an airproof packing 21*c* positioned in the cylinder tube 21 and he content transferring tube 29 extending from the leading end to discharge the content passing through the content passage 23*a* to the content brush 31 of the content brush body 30.

The support rim 29*a* is formed on a rear outer circumference of the content transferring tube 29 to support an end of the spring 27 and hinge shafts 29*b* are formed on both sides of the leading end adjacent to the support rim 29*a* such that hinge blocks 25*a* of the first link bar 25*a* formed in the folding link 25 are hinged thereto. The leading end of the content transferring tube 29 is connected to a content introducing tube 31 of the content brush body 30.

Meanwhile, the folding link 25 reciprocating the piston 23 is made by coupling the first link bar 25*a* to second link bar 25*b*. The first link bar 25*a* has a central linking bar (not shown) and an approximate I-shape in viewing from a side and an approximate H-shape in viewing from a front side. The first link bar 25*a* has hinge blocks 25*a*' and 25*a*" formed on lateral end thereof.

The hinge block 25*a*' is hinged to the hinge shaft 29*b* of the content transferring tube 29, while the other hinge block 25*a*" is connected to hinge shafts 25*b*' of the second link bar 25*b*. That is, the second link bar 25*b* connected to the first link bar 25*a* is split by a width corresponding to a diameter of the content transferring tube 29 and has rolling wheels 25*b*" formed at ends and the hinge shafts 25*b*' formed on both ends of an extension bar 25*c* extending from the rolling wheels 25*b*" and integrated into one body such that the first link bar 25*a* is connected to the hinge shafts 25*b*'. Therefore, the second link bar 25*b* has an approximate tuning fork shape.

The folding link 25 is driven when a portion to which the first link bar 25*a* and the second link bar 25*b* are connected is pressed by the pressure button installed in the button-mounting groove 11*b* of the outer body 11.

The content brush body 30 has a rear end undercut mounted to the leading end of the outer body 11, the content-introducing tube 32 connected to the content transferring tube 29 to allow the content introducing therein and having the check valve 60 opened and closed by the pumping operation of the piston 23, and a cam surface 33 formed on a portion facing the content-introducing tube 32, so that a stroke of the folding link 25 may be adjusted by the rotation of the content brush body 30.

The content brush 31 is installed in the leading end of the content-introducing tube 32 such that the content introduced into content-introducing tube 32 may be discharged out to the content brush 31.

Figure 7:
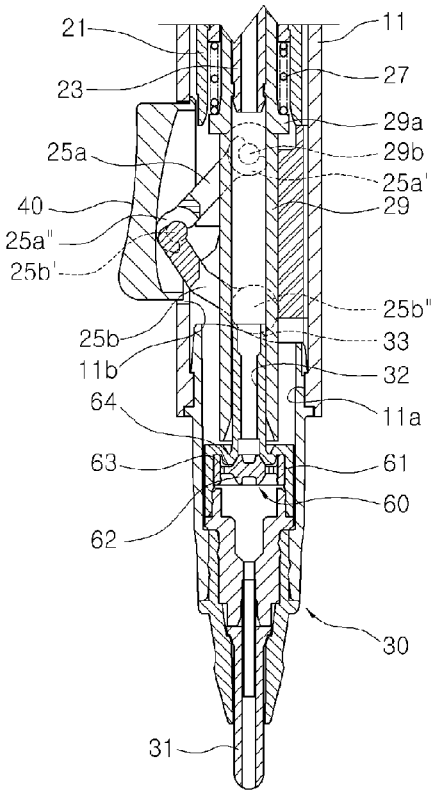
FIG. 7 is a sectional view illustrating a content brush of a container for dispensing a preset quantity of liquid content according to another embodiment of the present invention.
Figure 8:
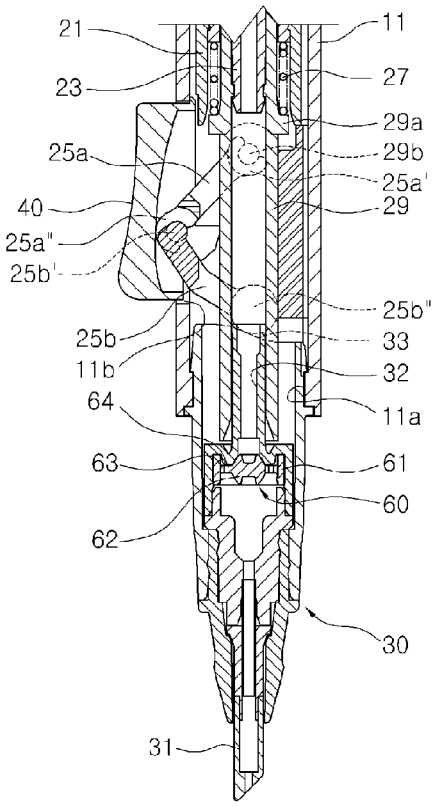
FIG. 8 is a sectional view illustrating a content brush of a container for dispensing a preset quantity of liquid content according to still another embodiment of the present invention.
Figure 9:
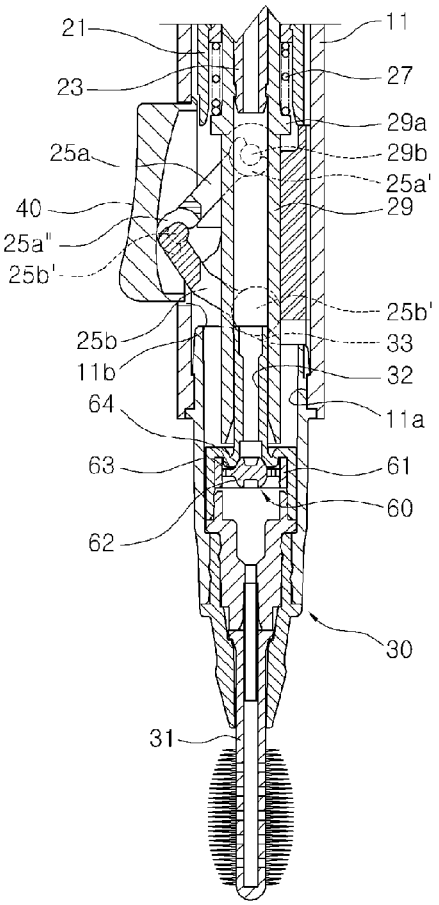
FIG. 9 is a sectional view illustrating a content brush of a container for dispensing a preset quantity of liquid content according to still another embodiment of the present invention.

In addition, the content brush 31, as illustrated in FIGS. 1, 2, and 4 to 6, may be made in the form of a brush in which hairs are concentrated. The content brush 31 may have an end in the form of a rod with a semi-spherical shape or a slope as illustrated in FIGS. 7 to 9 or a detachable structure for the convenient replacement.

The check valves 50 and 60, which are respectively installed in the cylinder tube 21 and the content brush body 30, have opening balls 52 and 62 provided in the annular rims 51 and 61. The opening balls 52 and 62 include diaphragms 54 and 64 with content-transferring openings 53 and 63.

The content brush 31 of the content brush body 30 is protected by a protective cover 80. The protective cover 80 is detachably attached to the content brush body 30.

Figure 4:
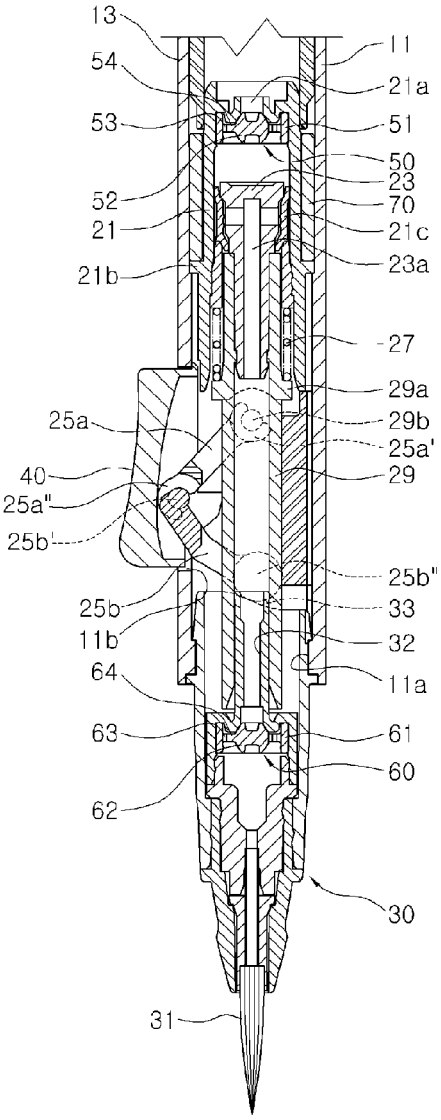
FIG. 4 is a sectional view illustrating main parts of a container for dispensing a preset quantity of liquid content according to an embodiment of the present invention.

Operations of the container for dispensing a preset quantity of liquid content according to an embodiment of the present invention as described above are described as below. When the content accommodated in the content case 11 of the main body 10 is discharged, the protective cover 80 mounted on the content brush body 30, as illustrated in FIG. 4, is separated from the content brush body 30 and the pressure button 40 installed in the button-mounting groove 11*b* of the outer body 11 is pressed down to drive the pumping member 20.

Figure 5:
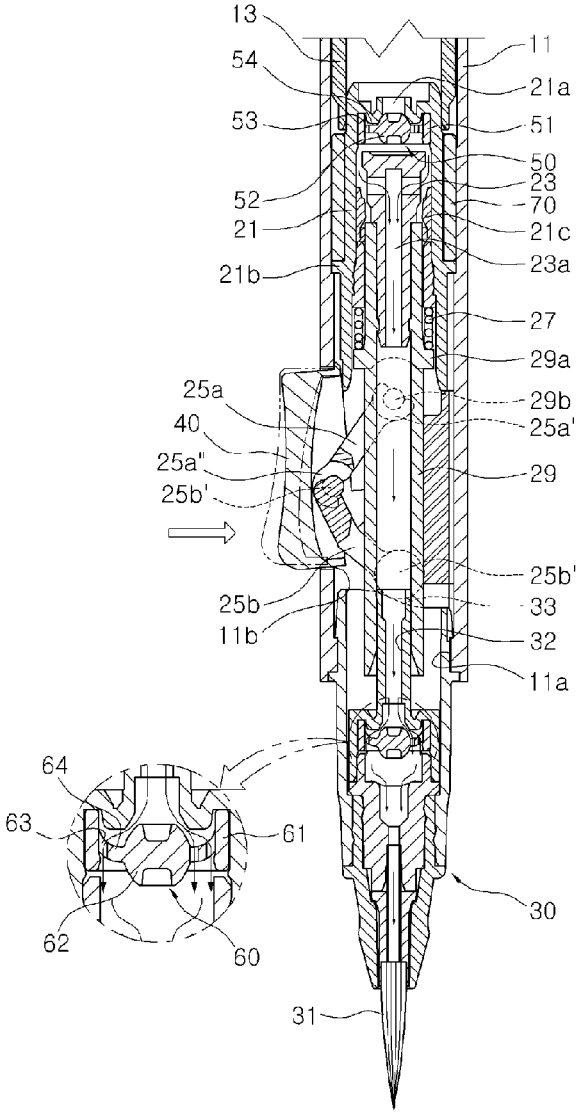
FIG. 5 is a view illustrating an operation of pressing a pressure button of a container for dispensing a preset quantity of liquid content according to an embodiment of the present invention to discharge the content.

That is, when the pressure button 40 is pressed down as illustrated in FIG. 5, the hinge blocks 25*a*" and the hinge shafts 25*b*' connecting the first link bar 25*a* to the second link bar 25*b* of the folding link 25 pivot and the first link bar 25*a* and the second link bar 25*b* are unfolded.

As such, when the first link bar 25*a* and the second link bar 25*b* are unfolded, the rolling wheels 25*b*" of the second link bar 25*b* are supported on the cam surface 33 which forming the rear end of the content brush body 30, and a moving force is generated from the first link bar 25*a*.

As described above, the rolling wheels 25*b*" are supported on the cam surface 33 so that the stroke of the folding link 25 may be adjusted, and thus the stroke of the pumping member 20 may be also adjusted to control a pumping force required to discharge the content out.

When the moving force is generated from the first link bar 25*a* on which the rolling wheels 25*b*" are supported, the content-transferring tube 29 hinged to the hinge blocks 25*a*' of the first link bar 25*a* moves rearward and the piston 23 connected to the content-transferring tube 29 moves rearward in association with the movement of the content-transferring tube 29.

As such, the piston 23 moves rearward by the content-transferring tube 29, so that the content introduced into the cylinder tube 21 is fed to the content brush 31 through content passage 23*a* of the piston 23.

In more detail, when the content-transferring tube 29 and the piston 23 move rearward together, the content-introducing hole 21*a* is blocked by the check valve 50 installed in the cylinder tube 21 and the piston 23 is separated from the airproof packing 21*c* to open the content passage 23*a*, so that the content is transferred into the content passage 23*a*.

In this case, the content-introducing tube 32 of the content brush body 30 is opened by which the check valve 60 is pushed and opened by a discharging pressure of the content transferred through the content passage 23*a* and the content introduced through the content-introducing tube 32 is discharged out to the content brush 31.

Figure 6:
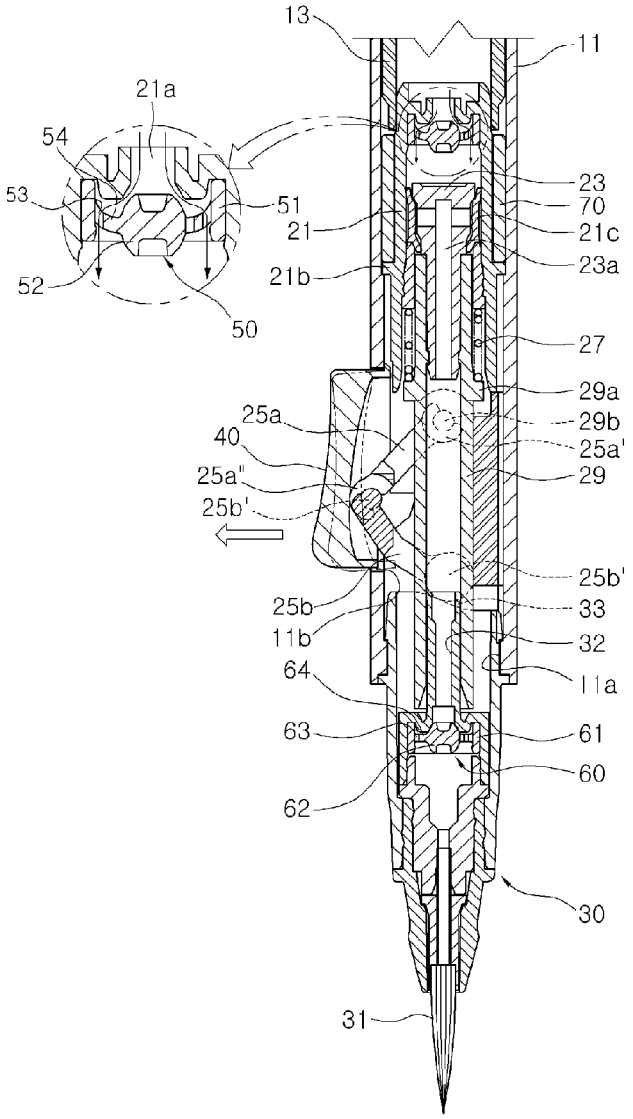
FIG. 6 is a view illustrating an operation of removing an external force applied to the pressure button of a container for dispensing a preset quantity of liquid content according to an embodiment of the present invention resulting in refilling of the content in a cylinder tube.

To the contrary, when the external force, as shown in FIG. 6, is removed from the pressed pressure button 40, the piston 23 moves toward the leading end so that the content accommodated in the content case 13 is introduced into the cylinder tube 21 through the content-introducing hole 21*a*.

That is, when the external force applied to the pressure button 40 is removed, the piston 23 moves toward the leading end due to the resilient force of the spring 27 an end of which is supported on the support rim 29*a* of the content-transferring tube 29 and a vacuum force is generated in the cylinder tube 21 is generated, so that the check valve 50 blocking the content-introducing hole 21*a* is separated such that the content accommodated in the content case 13 is introduced into the cylinder tube 21 and that the pushing member 13*a* installed in the content case 13 moves toward the leading end as long as the amount of the content introduced into the cylinder tube 21 within the content case 13.

The generation of the vacuum force within the cylinder tube 21 is enabled due to the content-introducing tube 32 blocked by the check valve 60 that is installed on the content-introducing tube 32 of the content brush body 30 to selectively open and close the content-introducing tube 32 repeatedly.

As such, after the content is discharged to the content brush 31 by pressing the pressure button 40, the protective cover 80 is mounted on the content brush body 30 to prevent the content brush 31 from being smeared with the foreign substances.

While the present invention has been described with respect to certain preferred embodiments, it will be apparent to those skilled in the art that various changes and modifications may be made without departing from the scope of the invention as defined in the following claims, and that these changes and modifications fall within the scope of the invention.

What is claimed is:

1. A container for discharging content therein, comprising: a content case installed inside the container for storing the content; a cylinder being installed inside the container, comprising:

an inlet hole formed on the top end for receiving the content from the content case;

a first check valve being installed at the top inside the cylinder wherein the first check valve allows the content to flow into the cylinder through the inlet hole from the content case in only one direction; and a piston being installed inside the cylinder for pumping the content introduced in the cylinder wherein the piston has a hollow body and at least one hole thereon being connected to the hollow body;

a second check valve being installed inside the container wherein the second check valve allows the content to flow to a brush being installed at the end of the container in only one direction;

a content transporting tube being securely installed between the piston and the second check valve in a such way that the content transporting tube transports the content introduced in the cylinder before the second check valve; and a button member installed on the surface of the container, comprising a button being connected to the piston, the button being configured to move the piston upward into the cylinder to pump the content out;

wherein when the button is pressed down by a user, the piston moves upward into the cylinder and pumps the contents introduced in the cylinder out through the piston hollow body all the way to the brush by creating a pressure to cause the second check valve to open and also force the first check valve to close; and wherein when the button is released, the piston is pulled back with an aid of a spring being installed on the content transporting tube by creating a vacuum force to cause the first valve to open and introduce a new content into the cylinder and also force the second valve to close.

2. The container according to claim 1, wherein the button member comprises a folding link driven by the button installed in a button-mounting groove of the container.

3. The container according to claim 2, wherein the container has a cam surface for adjusting a stroke of the folding link.

4. The container according to claim 2, wherein the folding link comprises: a first link bar hinge including a first hinge block hinged to a hinge shaft formed on the rear end of the content transporting tube and a second hinge block formed on a position opposed to the first hinge block; and a second tuning fork-shaped link bar spilt by a width corresponding to a diameter of the content transporting tube and including rolling wheels provided at the end, and hinges shafts formed on both ends of an extension bar that is formed at the upper central portion to which the hinge block of the first link bar is connected.

5. The container according to claim 1, wherein the content transporting tube has a locking annular rim being formed on the content transporting tube for installing the spring attached to the content transporting tube.

* * * * *